US007635010B1

(12) United States Patent
Manno et al.

(10) Patent No.: US 7,635,010 B1
(45) Date of Patent: Dec. 22, 2009

(54) CEMENT EQUIPMENT WASHOUT SYSTEM

(76) Inventors: Joseph J. Manno, 2329 Rue de Anne, La Jolla, CA (US) 92037; Tullio J. DeCollibus, 27 Viewpoint Pl., Laguna Nigel, CA (US) 92677

( * ) Notice: Subject to any disclaimer, the term of this patent is extended or adjusted under 35 U.S.C. 154(b) by 0 days.

(21) Appl. No.: 12/499,341

(22) Filed: Jul. 8, 2009

(51) Int. Cl.
*B08B 9/02* (2006.01)
*B65B 1/04* (2006.01)

(52) U.S. Cl. ..... 141/86; 15/104.05; 15/104.16; 134/104.4; 141/1

(58) Field of Classification Search ..... 15/104.04, 15/104.05, 104.16; 134/104.4; 141/1, 86
See application file for complete search history.

(56) References Cited

U.S. PATENT DOCUMENTS 4,007,821 A * 2/1977 Schiffelbein ..... 193/4
4,460,005 A * 7/1984 Rodger ..... 134/104.4
5,127,740 A * 7/1992 DeBoer ..... 366/2
5,741,065 A * 4/1998 Bell et al. ..... 366/54
6,155,277 A * 12/2000 Barry ..... 134/104.4
6,783,007 B2 * 8/2004 Arbore ..... 209/421
7,506,672 B2 * 3/2009 Manno ..... 141/86
7,594,524 B2 * 9/2009 DeCollibus et al. ..... 141/86

* cited by examiner

*Primary Examiner*—Randall Chin
(74) *Attorney, Agent, or Firm*—Richard D. Clarke

(57) ABSTRACT

The present invention is directed to a unique portable system of washing out and cleaning the inside and outside of pipes and hoses along with the other equipment used when dealing with cement and mortar at a construction site where the residue and water must be contained and removed from the site. The system consisting of a base frame unit with a pivoting waste holding basin and one or more washout trays can easily pass through a three foot doorway and be used on the upper floors of high-rise buildings.

20 Claims, 4 Drawing Sheets

CEMENT EQUIPMENT WASHOUT SYSTEM

FIELD OF THE INVENTION

This application deals with handling and removing the water and residue from the cleaning process of pipes, hoses and other equipment used when pumping or handling cement and mortar at a construction site, especially in high-rise buildings and other relatively inaccessible locations where hazardous waste must be contained.

BACKGROUND OF THE INVENTION

The existing method of washing out the interior and exterior of the cement and mortar transport pipes and hoses used in pumping these materials at construction sites is difficult and creates an excessive amount of hazardous waste. During the construction of multi-story buildings, the cleaning process is increasingly more difficult where environmental restrictions and disposal of hazardous waste presents very difficult problems, and that there are a greater number of pipes or hoses and other equipment that requires cleaning, than on residential projects.

The saving factor is that these types of slurry materials can be pumped back into the empty delivery trucks and reused. Getting rid of and containing the slurry materials used in the cleaning process in the past has been a major problem. In the construction of high-rise buildings, the use of rigid pipes or various dimensions that are ten feet long with connecting couplings, are often used to pump the construction materials to the upper elevations. In other cases, flexible hoses of varying diameters are used for pumping the construction materials. In all cases, the pipes and hoses and other equipment from large articles down to small items like shovels and trowels, must be cleaned immediately at the completion of the process, especially the pipes and hoses because the thin slurry material will harden very rapidly within them and be impossible to remove later. This type of construction equipment is very costly and not easily replaced. There is a need for a portable unit that can easily be transported and moved through doorways, and even to the upper floors of high-rise buildings that will accelerate the cleaning process along with reducing the quantity of water used.

This application provides a unique portable system of washing out and cleaning the inside and outside of pipes and hoses along with the other equipment used when dealing with cement and mortar at a construction site where the residue and water must be contained and removed from the site. The residue from this process is considered a hazardous waste and cannot be allowed to go into the drainage system.

Many innovations for cleaning the equipment used in the cement business have been provided in the prior art that are described as follows. These patents exemplify the need for containing and removing this hazardous waste through out the entire process. Even though these innovations may be suitable for the specific individual purposes to which they address, they differ from the present design as hereinafter contrasted. The following is a summary of those prior art patents most relevant to this application at hand, as well as a description outlining the difference between the features of the Cement Equipment Washout System and the prior art.

U.S. Pat. No. 4,460,005 of Edward F. Rodger describes a new and improved apparatus for washing soiled tubular members in a cleaning fluid wherein the apparatus includes a cleaning fluid tank for containing the cleaning fluid therein, support members with the cleaning fluid tank for supporting the tubular member between positions in and out of the cleaning fluid tank, along with directing means for directing cleaning fluid against the soiled tubular member and collection members with the cleaning fluid tank for collecting sludge formed during the washing of the tubular member.

This patent describes a highly efficient apparatus for washing soiled tubular members with a cleaning fluid that would not work efficiently to clean the inside of pipes used to pump cement or mortar. Any cleaning fluid other than water could not be returned to the delivery truck. It has not been described as a portable unit and could not be easily transported to the upper levels of high rise buildings under construction U.S. Pat. No. 5,127,740 of Richard D. DeBoer tells of a system and method for reclaiming unused portions of mixed cement by adding a chemical agent to retard the hydration state of the cement for up to several days. When the stored cement is again desired for use, a chemical accelerating agent is added to the mixed cement that returns the hydration state to normal, once again allowing the cement to set. The cement can then be poured at a construction site or alternatively, the stored cement can be added to a new batch of newly mixed cement before pouring.

This patent tells of a system and method for reclaiming unused portions of mixed cement but does not provide a lightweight portable system for washing cement tools and equipment.

U.S. Pat. No. 5,741,065 of Foyster G. Bell et al. discloses an invention that provides systems, methods and apparatus for cleaning a mixing truck by removing and recycling any non-delivered material. In one exemplary system, the invention is preferably attached to a mixing truck having at least one delivery chute and a loading hopper. A rail is configured to be attached to the mixing truck so that the bottom end is near a ground surface and the top end is near the loading hopper. The system further comprises a canister that is movable between the delivery chute and the rail. A lifting mechanism is movably attached to the rail and includes a securing device so that the lifting mechanism may secure and transport the canister along the rail. In this manner, material remaining in the delivery chute may be washed into the canister when positioned below the chute. The canister may then be moved near the rail and secured to the lifting mechanism that in turn transports the canister to the loading hopper where the contents may be emptied.

This patent discloses an invention that provides systems, methods and apparatus for cleaning a mixing truck by removing and recycling any non-delivered material. Although this patent illustrates the need for recycling non-deliverable material which includes the slurry from the cleaning processes it does not provide a portable device that can be moved to remote locations including high-rise buildings for the cleaning of the concrete or mortar covered equipment used on the job sites.

U.S. Pat. No. 6,155,277 of C. Marvin Barry describes an apparatus for containing and filtering rinse water, sediment and aggregate resulting from washing the hopper and discharge chute components of a cement truck at a construction site following use. The apparatus comprises a container removably mountable on the end of the discharge chute, the container having an open upper end, a screen removably positionable within the container and an outlet located in a lower portion of the container below the screen. The apparatus further includes a pump mountable on the truck, the pump having a suction hose extending between the container outlet and the pump, and a discharge hose extending from the pump to an open end discharging into the mixing drum. When the pump is operating, rinse water and relatively small particle size sediment flushed down the chute and into the container is automatically conveyed through the suction and discharge hoses into the mixing drum. The screen has openings approximately ¼ inches in diameter to trap relatively large particle size aggregate thereby preventing clogging of the pump fittings. The apparatus avoids the need for a designated truck wash-off station at the construction site and prevents contamination of the site or adjoining waterways with cementitious debris.

This patent describes another apparatus illustrating the need for containing and filtering rinse water, sediment and aggregate resulting from washing the hopper and discharge chute components of cement trucks at a construction site but does not provide the unique portability of the Cement Equipment Washout System.

U.S. Pat. No. 6,783,007 of Cataldo S. Arbore tells of a device enabling the timely removal and subsequent recycling of residues remaining in a pouring chute through which the load of a cement from a mixing drum of a mobile delivery vehicle was discharged. A strainer on a movable arm attached to the vehicle is placed under the chute to receive an effluent which results from spraying the inside of the nozzle with water. Solid particulates are retained by the strainer and slurry which emerges from the strainer is pumped into the mixing drum, allowing the separated materials to be recycled when the vehicle returns to its base.

This patent tells of a device enabling the timely removal and subsequent recycling of residues remaining in a pouring chute of a delivery truck. It does not deal with a portable device that can be used in the process of cleaning cement and mortar pumping equipment.

U.S. Pat. No. 7,506,672 of Joseph J. Manno is directed at a cement slurry collection chute basin that incorporates a leak proof means, no matter what the size or condition of the end of the concrete flop chute. By using a forward angled entry trough with a square large basin area having the attachment hooks in a forward position, the weight is put in the rear and the forward edge of the device is held forward of the end flange and tight against the lower surface of the concrete chute. A screen separates the aggregate from the cement slurry, which flows out a drain orifice in the bottom. An alternate embodiment is constructed from "half-pipe" housing. This alternate embodiment cement slurry collection chute basin will be much more efficient and economical to manufacture because of the "half-pipe" construction and the ease with which it could be welded and fabricated into a form.

This patent of the individual making application for the present device does not deal with the unique light weight portable system that can be adapted to wash out the inside and outside of large diameter cement transport pipes and hoses as well as smaller hand tools. The unique feature is that the Cement Equipment Washout System is a lightweight portable system that can be transported to remote locations as well as up into high-rise buildings.

None of these previous efforts, however, provides the benefits attendant with the Cement Equipment Washout System. The present design achieves its intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of the in detail it is to be understood that the design is not limited in its application to the details of construction and to the arrangement of the components set forth in the following description or illustrated in the drawings. The Cement Equipment Washout System is capable of other embodiments and of being practiced and carried out in various ways. In addition, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present design. It is important, therefore, that the claims be regarded as including such equivalent construction insofar as they do not depart from the spirit and scope of the present application.

SUMMARY OF THE INVENTION

The principal advantage of the Cement Equipment Washout System is to have a lightweight portable system for washing cement tools and equipment.

Another advantage of the Cement Equipment Washout System is that one or more wash out trays can be attached together to extend the washing capabilities.

Another advantage of the Cement Equipment Washout System is that it can be adapted to wash out the inside and outside of various diameter cement transport pipes.

Another advantage of the Cement Equipment Washout System is that it can be used to wash out a variety of sizes of flexible cement or mortar pumping hoses.

Another advantage of the Cement Equipment Washout System is that it is portable and can easily pass through a three-foot wide doorway.

Another advantage of the Cement Equipment Washout System is that it can easily be taken to the upper floors of high-rise buildings that are under construction.

Yet, another advantage of the Cement Equipment Washout System is that the waste holding basin pivots up for storage and down when in use.

Another advantage is that the waste holding basin can be adjusted to three different height positions.

Another advantage is the Cement Equipment Washout System can be used on small jobs without the washout trays for the cleaning of small tools like shovels and hand trowels.

And still another advantage is the waste holding basin has a screening tray to separate out the aggregate from the slurry mix.

And another advantage is the Cement Equipment Washout System is equipped with a pipe and hose internal cleaning tool where brushes, pipes and tubes in varying sizes and shapes are attached to the lower end.

And another advantage with the internal cleaning system, the amount of water used in the cleaning process is greatly reduced.

And still another advantage is the Cement Equipment Washout System can be attached to a conventional pump to transport the liquid slurry back into the delivery truck while sorting out the aggregate that is not considered a hazardous material.

A further advantage is the aggregate in the screening tray can be washed off before removing it from the waste holding basin.

These together with other advantages of the Cement Equipment Washout System, along with the various features of novelty, which characterize the design, are pointed out with particularity in the claims annexed to and forming a part of this disclosure. For a better understanding of the Cement Equipment Washout System, its operating advantages and the specific objects attained by its uses, reference should be made to the accompanying drawings and descriptive matter in which there are illustrated preferred embodiments of the Cement Equipment Washout System. There will thus been outlined, rather broadly, the more important features of the design in order that the detailed description thereof that follows may be better understood, and in order that the present contribution to the art may be better appreciated. There are additional features of the Cement Equipment Washout System that will be described hereinafter and which will form the subject matter of the claims appended hereto.

The preferred embodiment of the Cement Equipment Washout System consists of a base frame assembly consisting of a welded tubing framework with a sheet metal plate on each side. The sheet metal plates have cutouts that allow the pivoting axle of the waste holding basin to be adjusted to three different levels. The front two legs or the base frame assembly support the unit in the stationary position while two wheels at the rear allow the unit to be moved easily. When the system is in use, a brake is employed to prevent the wheels from rolling. Two support rods are located on each side of the unit to support the washout trays when the unit is in transit. Bungee cords will hold the washout trays in the upright position.

The waste holding basin preferably will be manufactured by a rotational molding process that can use a variety of different polymer materials. With this process, varying wall thickness is available making a durable container with very smooth internal surfaces and no sharp corners that can be easily cleaned. It must be understood at this time that a wide variety of manufacturing processes can be used to create the waste holding basin and all will remain within the scope of this application. The waste holding basin has a steel support saddle that allows it to rests on a steel pivoting axle. Within the waste holding basin is an aggregate screening tray that will remove the aggregate from the slurry mix. The waste holding basin can rotate on the pivoting axle from an upright stored position to a lowered position where one or more washout trays will attach.

A variety of lengths of washout trays will be available with a preferable length of fifty-eight inches. With this dimension, two lengths would be adequate to washout ten-foot lengths of pipe or hose. The washout trays will attach by the means of two round pins attached at the forward end mating with square tubing attached either to the waste holding basin or the adjacent washout tray. The round pin into the square tubing allows clearance in the corners minimizing the binding when there is a build up of cement on the pins and a close fit is not required. The flat surface of the washout tray rests on the upper surface of the opening of the waste holding basin or the preceding washout tray with the mating pin and square tube are below the two surfaces. A round pin in a round cavity generally does not leave enough clearance and binding will occur when there is sediment on the pins. The washout trays are supported at the outer end by the means of sleeves welded to each side where adjustable height legs can be inserted. One or more washout trays can be used for this process with the last washout tray having an end wall to keep the slurry within the washout tray.

The Cement Equipment Washout System can even work effectively without the washout trays for the process of cleaning smaller cement working tools like shovels and hand trowels. A drain shutoff valve is located at the appropriate location so that when the waste holding basin is rotated into the down position it will drain properly. Connections can be made at this point to pump the slurry back into the delivery truck or an appropriate container. If the device is being used on the upper levels of a structure, a gravity drain back into the delivery truck is possible. Additionally, waste slurry may be discharged by gravity only into waste containers such as 50 gallon drums and the like.

The Cement Equipment Washout System is equipped with a pipe and hose internal cleaning tool used to clean the inside of cement or mortar pipes or hoses. This tool is composed of brushes in varying sizes attached to the lower end ofone or more pipe sections with a perforated portion at the end that is used to scrub and pressure wash the inside of pipes and flexible hoses. The brushes may come in varying sizes and shapes with the preferred configuration being in a conical shape that will make them easier to insert into the pipes or hoses. The pipe sections can be coupled to make up the internal cleaning tool to the desired length. The upper end pipe section will be equipped with a manual shutoff valve. The washout trays allow the outside of the pipes or hoses to also be cleaned in the process with the residue going into the waste holding basin.

With respect to the above description then, it is to be realized that the optimum dimensional relationships for the parts of this application, to include variations in size, materials, shape, form, function and manner of operation, assembly and use, are deemed readily apparent and obvious to one skilled in the art. All equivalent relationships to those illustrated in the drawings and described in the specification intend to be encompassed by the present disclosure. Therefore, the foregoing is considered as illustrative only of the principles of the Cement Equipment Washout System. Further, since numerous modifications and changes will readily occur to those skilled in the art, it is not desired to limit the design to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of the Cement Equipment Washout System and together with the description, serve to explain the principles of this application.

For a fuller understanding of the nature and advantages of the Cement Equipment Washout System, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

Figures 1, 2:
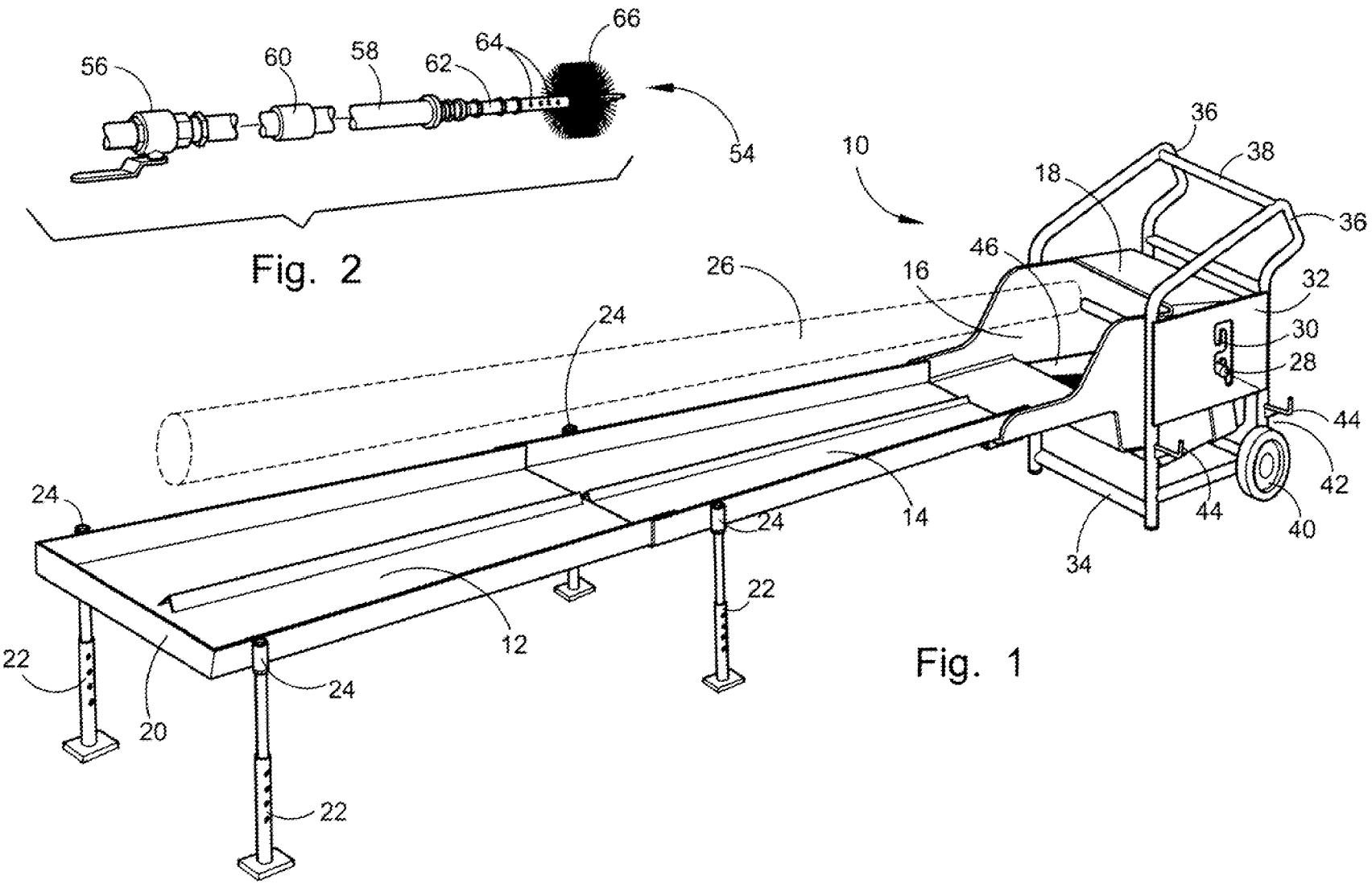
FIG. 1 depicts a Perspective view of the Cement Equipment Washout System in the lowered cleaning position using two washout trays.
FIG. 2 depicts a perspective view of the pipe and hose internal cleaning tool.

Referring now to the drawings wherein similar parts of the Cement Equipment Washout System 10 are identified by like reference numerals, there is seen in FIG. 1 a perspective view of the preferred embodiment of the Cement Equipment Washout System 10 in the lowered cleaning position using two washout trays 12 and 14 resting in the opening 16 of the waste holding basin 18. The rear washout tray 12 has a back wall 20 to eliminating spilling the slurry, while the front washout tray 14 is open at the back and front providing overlapping joints. Washout tray 12 can be used attached to the waste holding basin 18 for a single tray application. A variety of lengths of washout trays 12 and 14 will be available depending upon the application. Adjustable height legs 22 are attached to the washout trays 12 and 14 by the means of pipe sleeves 24 welded to the sides of the washout trays 12 and 14. A typical cement pumping rigid pipe 26 is shown in phantom above the washout trays 12 and 14. At this time it must be noted that the design depicted has been made for two large diameter pipes because the unit would fit through a three foot opening, but it must be understood that a variety of widths and sizes could be used for this purpose and they would all be covered within the scope of this application.

The waste holding basin 18 is held in position by the means of the steel pivot rod 28 extending through one of the adjustable height position slots 30 in the sheet metal side plate 32 of the base frame unit 34. The base frame unit 34 illustrated with two hand grip members 36 and a hand cross bar 38 has been shown as constructed of welded tubular members but it must be understood that it could be constructed of a wide variety of shapes and sizes of material to perform this function and still remain within the scope of this application. Two wheels 40 on the backside 42 of the base frame unit 34 provide easy portability when the unit is tilted back. Two washout tray support rods 44 are located on each side of the base frame unit 34 to support the washout trays 12 and 14 when the unit is in transit. A small portion of the aggregate screen tray 46 is visible within the waste holding basin 18.

FIG. 2 depicts a perspective view of the pipe and hose internal cleaning tool 54 where a manual water flow control valve 56 is shown on the rear distal end. One or more pipe sections 58 will be joined by conventional pipe couplings 60 to make up the desired length that will be easily transported. Spray and brush section 62 of varying sizes and shapes will be connected to the forward pipe section 58 to accommodate a series of spray orifices 64 and a brush section 66 for different sizes of pipes and hoses.

Figures 3, 4:
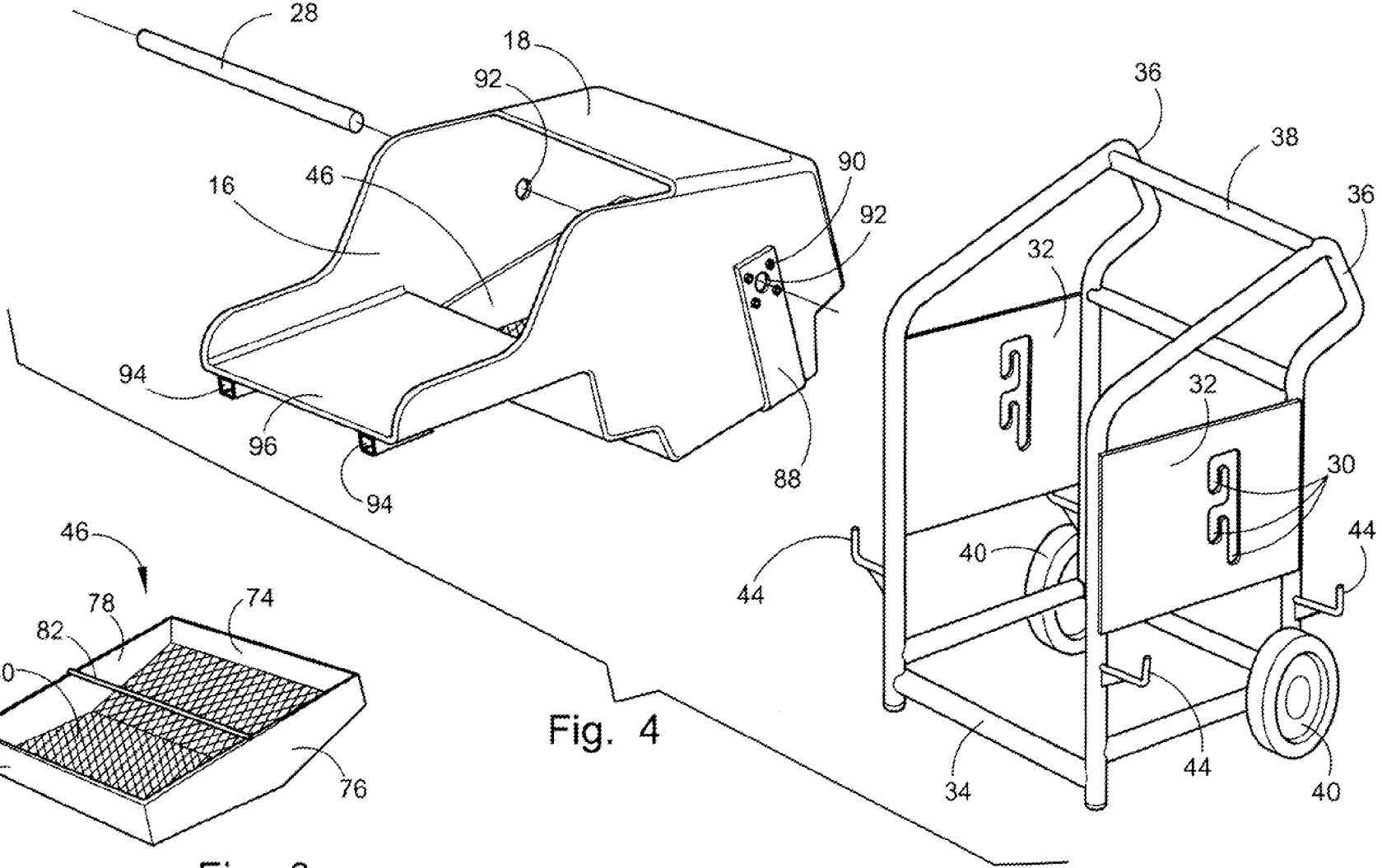
FIG. 3 depicts a perspective view of the aggregate screen tray.
FIG. 4 depicts an exploded view of the base frame unit with the waste holding basin and the steel pivoting rod.

FIG. 3 depicts a perspective view of the aggregate screen tray 46 with a front wall 72 and a rear wall 74 with side walls 76 and 78 having a "V" shape at the bottom concentrating the material at the center of the aggregate screen 80. One or more lifting bar handles 82 are attached between the side walls 76 and 78.

FIG. 4 depicts an exploded view of the base frame unit 34 with the waste holding basin 18 and the steel pivoting rod 28. A full view of the base frame unit 34 illustrates the location of the sheet metal side plates 32 attached to each side incorporating the matching adjustable height positioning slots 30. The washout tray support rods 44 are clearly identified on each side of the base frame unit 34. A steel support saddle 88 extends from one side of the waste holding basin 18 across the bottom and up the other side with matching mounting hardware 90 and pivot rod orifices 92. Two, washout tray mounting square tubes 94 are located below the flat entry surface 96 at the waste holding basin opening 16.

Figures 5, 6, 7, 8:
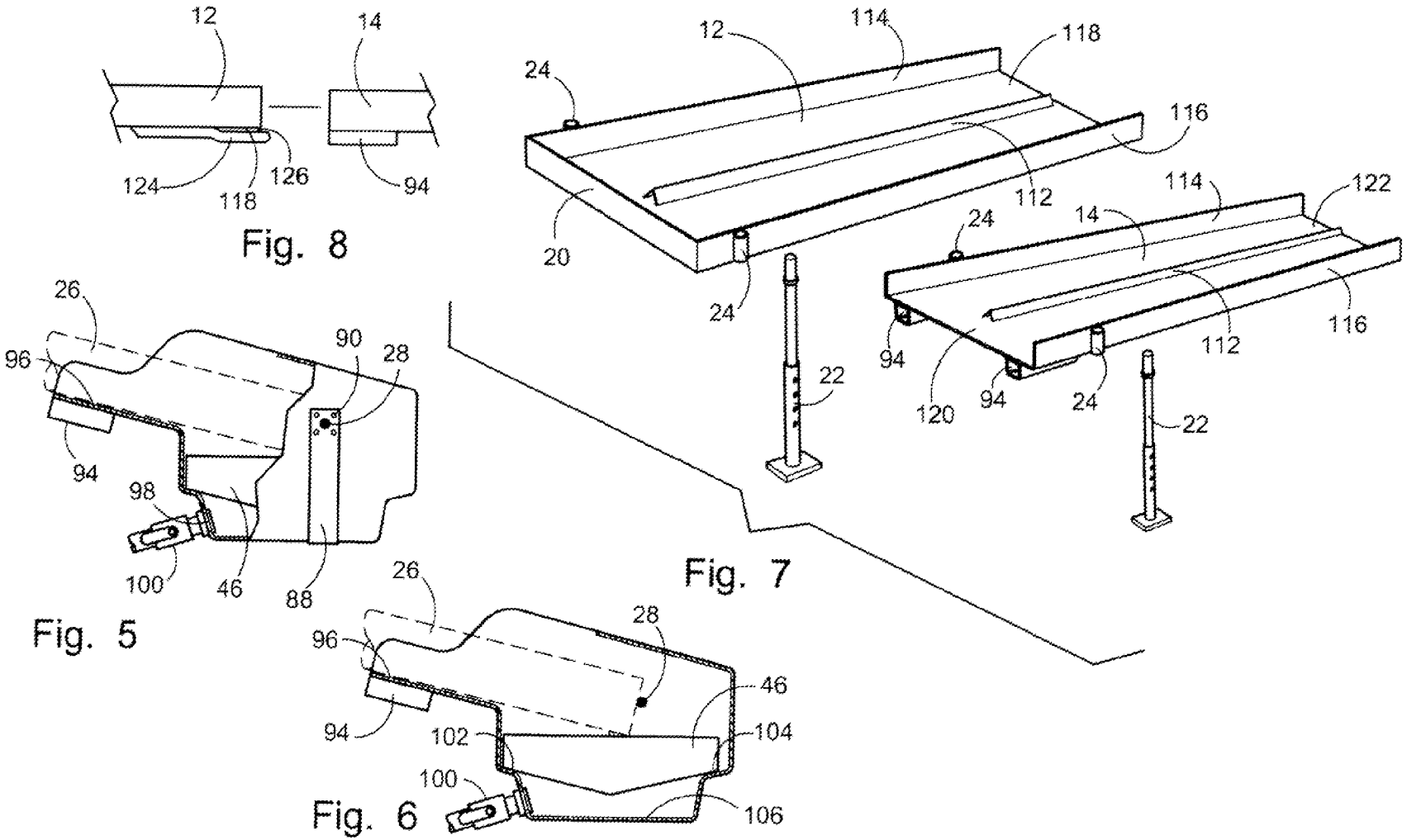
FIG. 5 depicts a partial cross section of the waste holding basin illustrating the location of the steel support saddle.
FIG. 6 depicts a full cross section of the waste holding basin illustrating the location of the aggregate screen tray and the ability of the steel pivoting rod to act as a stop for positioning pipes with the waste holding basin.
FIG. 7 depicts a perspective view of two sections of washout trays with a single leg of each removed.
FIG. 8 depicts a side view of section of the forward and rear washout trays illustrating the mating parts.

FIG. 5 depicts a partial cross section of the waste holding basin 18 illustrating the location of the steel support saddle 88 and the drain valve orifice 98 and the manual drain valve 100. FIG. 6 depicts a full cross section of the waste holding basin 18 illustrating the location of the aggregate screen tray 46 and the ability of the steel pivoting rod 28 to act as a stop for positioning pipes 26 within the waste holding basin 18. Additional orifices and pipe stop bars can be added at different locations as desired. A shoulder 102 at the front and a second shoulder 104 at the rear retain the aggregate screen tray 46 above the lower surface 106 of the waste holding basin 18.

FIG. 7 depicts a perspective view of two washout trays 12 and 14 illustrating a single adjustable height leg 22 of each removed from the corresponding pipe sleeves 24 welded to the sides of the washout trays 12 and 14. Each washout tray will have two or more of these types of supports. A steel angle 112 divides the washout trays 12 and 14 into separate sections and adds to the longitudinal stiffness of each unit. Sidewalls 114 and 116 on each unit keep the material from going over the sides and add additional stiffness. The width of the rear washout tray 12 is narrower than the width of the front washout tray 14 allowing the trays to overlap where the forward flat surface 118 rests on the rear flat surface 120 when the trays are joined together. This also occurs where the forward flat surface 122 rests on the flat entry surface 96 of the waste holding basin 18.

FIG. 8 depicts a side view of a section of the forward and rear washout trays 12 and 14 illustrating the mating parts where the locating pins 124 mates with the tray mounting square tube 94. The gap 126 between the locating pin 124 and the forward flat surface 118 allows the surfaces to overlap while adding strength to the joint.

Figure 9:
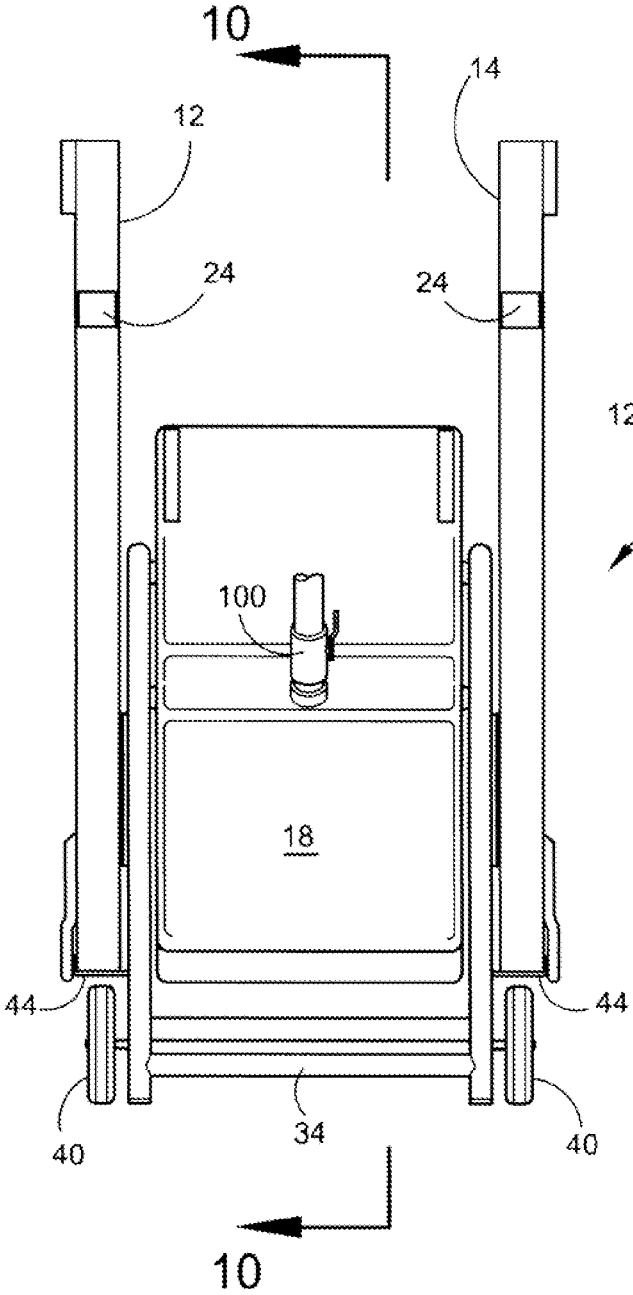
FIG. 9 depicts a front view of the Cement Equipment Washout System with the waste holding basin elevated into the upright position for transit and one washout tray on each side.
Figure 10:
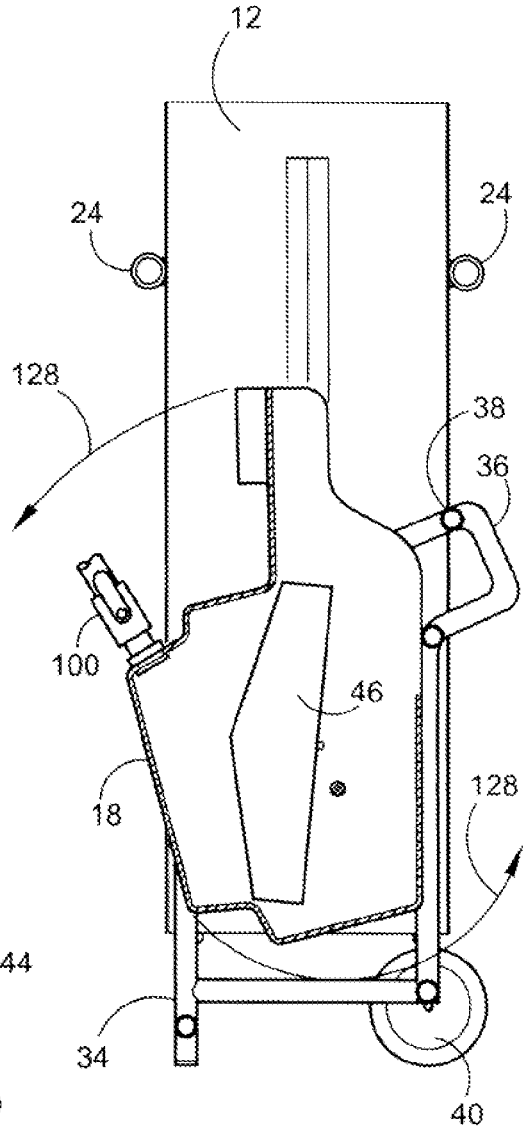
FIG. 10 depicts a cross section of the side view of the base frame unit and waste holding basin with the waste holding basin elevated into the upright position for transit having the aggregate screen tray inside and one washout tray on the side.

FIG. 9 depicts a front view of the Cement Equipment Washout System 10 with the waste holding basin 18 elevated into the upright position for transit with the washout trays 12 and 14 on each side. FIG. 10 depicts a cross section of the side view of the base frame unit 34 and waste holding basin 18 with the waste holding basin 18 elevated into the upright position for transit having the aggregate screen tray 46 inside and one washout tray 12 on the side. The rotational arrow 128, indicate the direction of rotation when the waste holding basin 18 is rotated from the upright position to the lowered working position.

The Cement Equipment Washout System 10 shown in the drawings and described in detail herein discloses arrangements of elements of particular construction and configuration for illustrating preferred embodiments of structure and method of operation of the present application. It is to be understood that elements of different construction and configuration and other arrangements thereof, other than those illustrated and described may be employed for providing a Cement Equipment Washout System 10 in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

We claim:

1. A cement equipment washout system comprising:

(a) a base frame unit having wheels attached thereto, and supporting an upper frame including a hand grip member and a hand cross bar;

(b) a waste holding basin with a waste opening pivotally attached to said unit;

(c) a variable length front washout tray attachable to said waste opening and a variable length rear washout tray attachable to said front washout tray wherein both said front washout tray and said rear washout tray include two or more integrated pipe sleeves; and (d) a pipe and hose internal cleaning tool having a brush section on one end and a pipe coupling and flow control valve on the opposite end;

whereby said cement equipment washout system is a complete single unit having all parts stored thereon, which is easily transported from one location to another assembled, used, then disassembled to be transported and used again.

2. The cement equipment washout system according to claim 1, wherein said waste holding basin is pivotally attached to said unit by a pivot rod passing through said washout holding basin at pivot rod orifices located in mounting hardware on a support saddle.

3. The cement equipment washout system according to claim 2, wherein said frame unit further includes side plates having adjustable height position slots for accepting said pivot rod and thereby making the washout holding basin attachment height adjustable.

4. The cement equipment washout system according to claim 1, wherein said waste holding basin includes a removable aggregate screen tray.

5. The cement equipment washout system according to claim 1, wherein said waste holding basin includes a drain valve orifice.

6. The cement equipment washout system according to claim 1, wherein said variable length rear washout tray and said variable length front washout tray accept two or more support legs within said two or more integrated pipe sleeves.

7. The cement equipment washout system according to claim 6, wherein said support legs have means for adjusting the height of said support legs.

8. The cement equipment washout system according to claim 1, wherein said pipe and hose internal cleaning tool having a brush section on one end and a pipe coupling and flow control valve on the opposite end further includes a plurality of spray orifices proximal to said brush section.

9. The cement equipment washout system according to claim 1, wherein said base frame unit and said upper frame include washout tray support rods for removably attaching said washout trays to said upper frame while the cement equipment washout system disassembled unit is stored or being transported.

10. The cement equipment washout system according to claim 1, wherein said variable length front washout tray further includes side walls and said variable length rear washout tray further includes side walls and a back wall.

11. A method for making a cement equipment washout system comprising the steps of:

(a) providing a base frame unit having wheels attached thereto, and supporting an upper frame including a hand grip member and a hand cross bar;

(b) providing a waste holding basin with a waste opening pivotally attached to said unit;

(c) providing a variable length front washout tray attachable to said waste opening and a variable length rear washout tray attachable to said front washout tray wherein both said front washout tray and said rear washout tray include two or more integrated pipe sleeves; and (d) providing a pipe and hose internal cleaning tool having a brush section on one end and a pipe coupling and flow control valve on the opposite end;

whereby said cement equipment washout system is a complete single unit having all parts stored thereon, which is easily transported from one location to another assembled, used, then disassembled to be transported and used again.

12. The method for making a cement equipment washout system according to claim 11, wherein said step of providing a waste holding basin pivotally attached to said unit further includes the step of providing a waste holding basin pivotally attached to said unit by a pivot rod passing through said washout holding basin at pivot rod orifices located in mounting hardware on a support saddle.

13. The method for making a cement equipment washout system according to claim 11, wherein said step of providing a base frame unit having wheels attached thereto, and supporting an upper frame including a hand grip member and a hand cross bar further includes side plates having adjustable height position slots for accepting said pivot rod and thereby making the washout holding basin attachment height adjustable.

14. The method for making a cement equipment washout system according to claim 11, wherein said step of providing a waste holding basin with a waste opening pivotally attached to said unit, further includes the step wherein said waste holding basin includes a removable aggregate screen tray.

15. The method for making a cement equipment washout system according to claim 11, wherein said step of providing a waste holding basin with a waste opening pivotally attached to said unit, further includes the step wherein said waste holding basin includes a drain valve orifice.

16. The method for making a cement equipment washout system according to claim 11, wherein said step of providing a variable length front washout tray attachable to said waste opening and a variable length rear washout tray attachable to said front washout tray wherein both said front washout tray and said rear washout tray include two or more integrated pipe sleeves, further includes the step wherein said variable length rear washout tray and said variable length front washout tray accept two or more support legs within said two or more integrated pipe sleeves.

17. The method for making a cement equipment washout system according to claim 11, wherein said step of providing a variable length front washout tray attachable to said waste opening and a variable length rear washout tray attachable to said front washout tray wherein said variable length rear washout tray and said variable length front washout tray accept two or more support legs within said two or more integrated pipe sleeves, further includes said support legs having means for adjusting the height of said support legs.

18. The method for making a cement equipment washout system according to claim 11, wherein said step of providing a pipe and hose internal cleaning tool having a brush section on one end and a pipe coupling and flow control valve on the opposite end, further includes a plurality of spray orifices proximal to said brush section.

19. The method for making a cement equipment washout system according to claim 11, wherein said step of providing a base frame unit having wheels attached thereto, and supporting an upper frame, further includes said base frame unit and said upper frame include washout tray support rods for removably attaching said washout trays to said upper frame while the cement equipment washout system disassembled unit is stored or being transported.

20. The method for making a cement equipment washout system according to claim 11, wherein said step of providing a variable length front washout tray attachable to said waste opening and a variable length rear washout tray attachable to said front washout tray, further includes said variable length front washout tray further includes side walls and said variable length rear washout tray further includes side walls and a back wall.

* * * * *